US006301900B1

(12) United States Patent
Mandai et al.

(10) Patent No.: US 6,301,900 B1
(45) Date of Patent: Oct. 16, 2001

(54) GAS TURBINE COMBUSTOR WITH FUEL AND AIR SWIRLER

(75) Inventors: Shigemi Mandai; Masataka Ohta; Hideki Haruta; Koichi Nishida; Shinji Akamatsu; Masahiro Kamogawa, all of Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/554,447

(22) PCT Filed: Sep. 17, 1999

(86) PCT No.: PCT/JP99/05095

§ 371 Date: Jul. 6, 2000

§ 102(e) Date: Jul. 6, 2000

(87) PCT Pub. No.: WO00/17578

PCT Pub. Date: Mar. 30, 2000

(30) Foreign Application Priority Data

Sep. 17, 1998 (JP) ..... 10-262756

(51) Int. Cl.[7] ..... F23R 3/14
(52) U.S. Cl. ..... 60/740; 60/748
(58) Field of Search ..... 60/740, 748

(56) References Cited

U.S. PATENT DOCUMENTS

| | | | |
|---|---|---|---|
| 2,483,951 | 10/1949 | Watson | 60/748 |
| 3,638,865 | 2/1972 | McEneny et al. | 60/748 |
| 3,788,067 | 1/1974 | Carlisle et al. | 60/748 |
| 3,937,011 | 2/1976 | Caruel et al. . | |
| 4,170,108 | 10/1979 | Mobsby . | |
| 5,303,554 | 4/1994 | Faulkner . | |
| 5,361,578 | 11/1994 | Donlan . | |

FOREIGN PATENT DOCUMENTS

| | | |
|---|---|---|
| 102729/1988 | 2/1990 | (JP) . |
| 6-213450 | 8/1994 | (JP) . |
| 6-213451 | 8/1994 | (JP) . |
| 478/1993 | 9/1994 | (JP) . |
| 10-2558 | 1/1998 | (JP) . |

*Primary Examiner*—Louis J. Casaregola
(74) *Attorney, Agent, or Firm*—Paul & Paul

(57) ABSTRACT

A nozzle cap (10) is disposed downstream of a nozzle body (1) of a combustor for a gas turbine, an inner surface part (12) of which is of a conical shape diverging downstream to define a fuel-jet guide (17) for guiding fuel jet ejected from one or more nozzle holes (3) provided at the center of a downstream end surface of the nozzle body. Fuel ejected from the one or more nozzle holes smoothly runs along the fuel-jet guide without remaining there to join with a swirl stream (S) in a swirl path (9), and to burn without generating smoke. Air introduced into a first auxiliary air path (6) defined between the nozzle body and a partition (5) at a position upstream thereof passes through a second auxiliary air path (16) defined between a downstream end surface (2) of the nozzle body (1) and an upstream end surface (13) of the nozzle cap and reaches an entrance (19) of the fuel-jet guide. The air then flows along the fuel-jet guide to cool the nozzle cap and prevent the fuel ejected from the one or more nozzle holes from sticking to the nozzle cap.

2 Claims, 1 Drawing Sheet

GAS TURBINE COMBUSTOR WITH FUEL AND AIR SWIRLER

TECHNICAL FIELD

The present invention relates to a combustor for a gas turbine.

BACKGROUND ART

As is well known, a combustor for a gas turbine is adapted so that a fuel ejected from one or more nozzle holes of a nozzle body is mixed with swirling air blowing from a swirl path formed around the nozzle body.

Particularly, when the nozzle body is of a cylindrical columnar shape having a wall at a tip end, i.e., a downstream end, and the one or more nozzle holes is located at the center of the downstream end wall as in a case of a pilot combustor, the swirl air flowing along the outer circumference of the nozzle body separates therefrom at the periphery of the downstream end wall of the nozzle body and generates circulation vortices into which the fuel ejected from the one or more nozzle holes is involved. This causes a problem in that smoke may be generated because the fuel burns while remaining therein (see FIG. 2).

The present invention has been made to solve the above-mentioned problem, and an object thereof is to provide a combustor for a gas turbine wherein fuel, ejected from the one or more nozzle holes at the center of a downstream end wall of a nozzle body is mixed with swirling air blowing from a swirl path formed around the nozzle body, is burnt without remaining near the one or more nozzle holes to prevent smoke from being generated.

DISCLOSURE OF THE INVENTION

According to the present invention, provision is made of a combustor for a gas turbine, wherein fuel ejected from one or more nozzle holes at the center of a downstream end wall of a nozzle body is mixed with swirling air blowing from a swirl path formed around the nozzle body. The combustor is characterized in that a nozzle cap of a generally conical shape diverging downstream from the one or more nozzle holes in a nozzle body is provided. According to the combustor for a gas turbine of such a type, the fuel ejected from the one or more nozzle holes flows along the nozzle cap without remaining thereon.

Preferably, the downstream end of the nozzle cap is united with the inner wall of the swirl path so that the nozzle cap forms a fuel-jet guide for smoothly guiding the fuel ejected from the one or more nozzle holes into the swirl path.

Also, a path for directing cooling air toward the one or more nozzle holes may be provided at the upstream end of the nozzle cap so that the nozzle cap is cooled by a flow of the cooling air along the fuel-jet guide to prevent fuel mist from sticking to the fuel-jet guide.

Further, a partition may be provided between the swirl path and a circumference of the nozzle body to define a narrow path between the circumference of the nozzle and the partition, the downstream end of the narrow path being connected to the upstream end of the cooling air path to take in cooling air from the upstream of the narrow path.

BEST MODES FOR CARRYING OUT THE INVENTION

Figure 1:
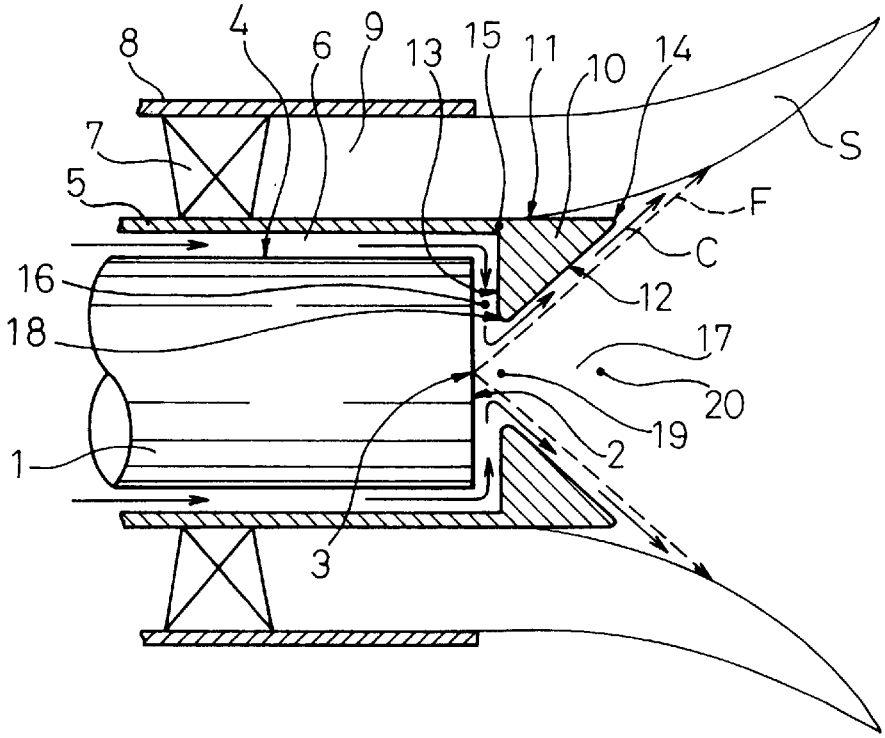
FIG. 1 is an illustration of a structure of one embodiment of a combustor for a gas turbine according to the present invention.

FIG. 1 illustrates a combustion chamber, in a combustor for a gas turbine, for forming a so-called pilot flame for igniting a main mixture gas which was formed by preliminary mixing of fuel and air.

A nozzle body 1 of a generally cylindrical columnar shape is provided at a center of a downstream end surface 2 with the one or more nozzle holes 3 (only position thereof is indicated) from which is ejected fuel. A tubular partition 5 is spaced outside a circumference 4 of the nozzle body 1 to define a first auxiliary air path 6 between the same and the nozzle body 1.

An outer tubular body 8 is arranged outside the tubular partition 5 via a swirler 7 to define a swirl path 9 between the tubular partition 5 and the outer tubular body 8. Air introduced into the swirl path 9 at an upstream position, not shown, passes through the swirler 7 and is converted to a swirling stream having rotating force as indicated by S. Air is also introduced into the first auxiliary air path 6 at an upstream position, not shown.

A nozzle cap 10 is provided downstream of the nozzle body 1 which has an outer surface part 11 and an inner surface part 12 both connected to each other by an upstream end surface 13 and by a downstream edge 14.

The outer surface part 11 of the nozzle cap 10 and an outer surface of the tubular partition 5 are flush with each other, and an upstream end 15 of the outer surface part 11 of the nozzle cap 10 is connected to a downstream end of the tubular partition 5. However, a gap is formed between the upstream end surface 13 of the nozzle cap 10 and a downstream end surface 2 of the nozzle body 1 to define an annular second auxiliary air path 16. The second auxiliary air path 16 communicates with the first auxiliary air path 6 around the outside thereof.

The inner surface part 12 of the nozzle cap 10 is of a conical shape diverging downstream to define a fuel-jet guide 17 for guiding fuel jet ejected from the one or more nozzle holes 3 of the nozzle body 1. The fuel-jet guide 17 has an entrance 19 defined by an upstream end edge 18 of the inner surface part 12 of the nozzle cap 10 and an exit 20 defined by a downstream end edge 14 thereof.

Fuel ejected from the one or more nozzle holes 3 of the downstream end surface 2 of the nozzle body 1 runs along the fuel-jet guide 17 defined by the inner surface part 12 of the nozzle cap 10 to be smoothly mixed with the swirling stream S without remaining thereon, and burns. As a result, smoke is prevented from being generated.

On the other hand, air introduced into the first auxiliary air path 6 at a position upstream thereof, not shown, passes through first auxiliary air path 6 and the second auxiliary air path 16, as shown by a solid arrow C, and reaches the entrance 19 of the fuel-jet guide 17, from which it flows along the fuel-jet guide 17 defined by the inner surface part 12 of the nozzle cap 10 and joins with the swirling stream S.

While this air is called cooling air because it cools the inner surface part 12 of the nozzle cap 10, it also has a function for preventing the fuel ejected from the one or more nozzle holes 3 on the downstream end surface 2 of the nozzle body 1 from sticking to the inner surface part 12 and being ignited there.

Figure 2:
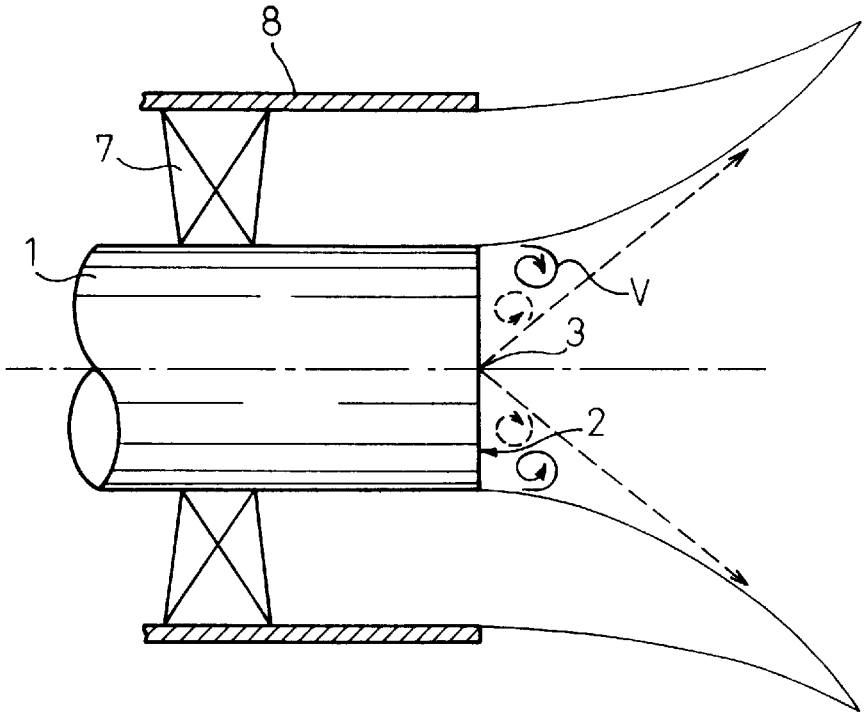
FIG. 2 is an illustration of a structure of a conventional combustor having no nozzle cap.

FIG. 2 illustrates a structure of an prior art combustor for a gas turbine having no nozzle cap 10, and a flow of fuel in such a case, wherein circulation vortices V generated behind the nozzle body 1 involve part of fuel therein. The fuel remains there and generates smoke.

As described above, the combustor for a gas turbine according to the present invention is provided with a nozzle cap of a generally conical shape, diverging downstream from a jet of a nozzle body, whereby fuel ejected from the jet of the nozzle body smoothly flows along the nozzle cap, without remaining there as in the prior art, resulting in no smoke being generated.

What is claimed is:

1. A combustor for a gas turbine comprising:

a nozzle body having one or more nozzle holes at the center of a downstream end wall thereof, said one or more nozzle holes being adapted to eject fuel;

a plurality of swirlers located in a space between an outer tubular body disposed around said nozzle body and said nozzle body; and a nozzle cap having a surface of a generally conical shape diverging downstream from said one or more nozzle holes of said nozzle body, said nozzle cap further having an upstream end surface which extends in parallel with said downstream end wall of said nozzle body so as to define a gap therebetween forming a cooling air path, wherein fuel ejected from said one or more nozzle holes is mixed with swirling air blowing from a swirl path formed by said plurality of swirlers, and wherein said surface of a generally conical shape forms a fuel-jet guide for smoothly guiding the fuel ejected from said one or more nozzle holes into the swirl path, and wherein said surface of a conical shape further defines an inlet opening of said fuel-jet guide such that cooling air introduced into said cooling air path flows out along the fuel-jet guide thereby cooling said fuel-jet guide.

2. A combustor for a gas turbine according to claim 1, wherein a partition is provided intermediate said plurality of swirlers and a circumference of said nozzle body to define a narrow path between said circumference of the nozzle body and said partition, said narrow path having a down stream end connected to said cooling air path.

* * * * *